US009020404B2

(12) United States Patent
Kim et al.

(10) Patent No.: US 9,020,404 B2
(45) Date of Patent: Apr. 28, 2015

(54) DEVELOPING UNIT CONTAINING MULTIPLE SUPPLY ROLLERS AND IMAGE FORMING APPARATUS USING THE SAME

(75) Inventors: Jin-hong Kim, Gyeyang-gu (KR); Joo-hwan Noh, Yongin-si (KR); Young-su Lee, Suwon-si (KR); Yun-kyu Sim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 904 days.

(21) Appl. No.: 13/075,770

(22) Filed: Mar. 30, 2011

(65) Prior Publication Data

US 2012/0051799 A1 Mar. 1, 2012

(30) Foreign Application Priority Data

Aug. 25, 2010 (KR) ..... 10-2010-0082644

(51) Int. Cl.
*G03G 15/08* (2006.01)

(52) U.S. Cl.
CPC ..... *G03G 15/0808* (2013.01)

(58) Field of Classification Search
USPC ..... 399/253, 255, 281
See application file for complete search history.

(56) References Cited

U.S. PATENT DOCUMENTS 5,286,918 A * 2/1994 Iwata et al. ..... 399/119
5,809,386 A * 9/1998 Iwata ..... 399/281
5,812,917 A 9/1998 Iwata et al.
5,839,021 A * 11/1998 Hayashi et al. ..... 399/55
6,041,208 A * 3/2000 Choi ..... 399/281
6,330,414 B1 * 12/2001 Takuma et al. ..... 399/267
6,343,201 B1 * 1/2002 Wada et al. ..... 399/281
6,519,437 B1 * 2/2003 Aoki et al. ..... 399/281
6,524,762 B2 * 2/2003 Tsutsui et al. ..... 430/108.8
6,721,527 B2 * 4/2004 Kanari et al. ..... 399/281
6,907,215 B2 * 6/2005 Yasukawa et al. ..... 399/281

(Continued)

FOREIGN PATENT DOCUMENTS

JP 10-020662 1/1998
KR 10-2005-0068050 7/2005

(Continued)

OTHER PUBLICATIONS

"Engage." The American Heritage(r) Dictionary of the English Language. Boston: Houghton Mifflin, 2011. Credo Reference. Web. Jul. 24, 2014.*

(Continued)

*Primary Examiner* — Clayton E Laballe
*Assistant Examiner* — Trevor J Bervik
(74) *Attorney, Agent, or Firm* — Staas & Halsey LLP

(57) ABSTRACT

A developing unit includes a toner storage portion for containing toner and a development portion for containing the toner supplied from the toner storage portion. The development portion includes a developing roller for supplying the toner to a photosensitive body, a supply roller and an auxiliary supply roller. The supply roller and the auxiliary supply roller rotate while facing each other to supply the toner to the developing roller. In the developing unit, an inequality that $|D-(R1+R2)| \leq 1.0$ mm is satisfied, where a distance between the centers of the auxiliary supply roller and the supply roller in a region where the auxiliary supply roller and the supply roller face each other is D, a radius of the supply roller is R1, and a radius of the auxiliary supply roller is R2.

24 Claims, 7 Drawing Sheets

(56) References Cited

U.S. PATENT DOCUMENTS

| | | | | |
|---|---|---|---|---|
| 7,221,892 | B2 * | 5/2007 | Sato | 399/283 |
| 2005/0141925 | A1 | 6/2005 | Kim et al. | |
| 2008/0292363 | A1 | 11/2008 | Moon et al. | |
| 2009/0103957 | A1 * | 4/2009 | Hirayama et al. | 399/285 |
| 2009/0274491 | A1 * | 11/2009 | Sato | 399/281 |
| 2010/0086333 | A1 | 4/2010 | Kim | |
| 2012/0045253 | A1 * | 2/2012 | Kim et al. | 399/281 |
| 2012/0148314 | A1 * | 6/2012 | Park et al. | 399/281 |

FOREIGN PATENT DOCUMENTS

| | | |
|---|---|---|
| KR | 10-2008-0102624 | 11/2008 |
| KR | 10-2010-0039655 | 4/2010 |

OTHER PUBLICATIONS

Korean Patent Abstracts, Publication No. 10-2010-0039655, published Apr. 16, 2010.

Korean Patent Abstracts, Publication No. 10-2008-0102624, published Nov. 26, 2008.

Korean Patent Abstracts, Publication No. 10-2005-0068050, published Jul. 5, 2005.

Patent Abstracts of Japan, Publication No. 10-020662, published Jan. 23, 1998.

* cited by examiner

DEVELOPING UNIT CONTAINING MULTIPLE SUPPLY ROLLERS AND IMAGE FORMING APPARATUS USING THE SAME

CROSS-REFERENCE TO RELATED APPLICATIONS

This application claims the benefit of Korean Patent Application No. 10-2010-0082644, filed on Aug. 25, 2010, in the Korean Intellectual Property Office, the disclosure of which is incorporated herein in its entirety by reference.

BACKGROUND

1. Field

The present invention relates to a developing unit that is detachable from an image forming apparatus, and an image forming apparatus employing the developing unit.

2. Description of the Related Art

In electrophotographic image forming apparatuses, an electrostatic latent image is formed on a surface of a photosensitive body by scanning light that is modulated according to image information onto the photosensitive body, the electrostatic latent image is developed into a visible toner image by supplying toner to the electrostatic latent image, and the toner image is transferred to a recording medium and fused thereto so that an image is printed on the recording medium.

The electrophotographic image forming apparatuses include a developing unit containing a developer. A one-component developing unit contains toner as a developer, whereas a two-component developing unit contains toner and carrier as a developer. When all the developer contained in a developing unit is consumed, the developing unit is detached from an image forming apparatus and a new developing unit is installed in the image forming apparatus.

SUMMARY

The present invention provides a developing unit that is capable of effectively supplying toner in the developing unit to a developing roller, and an electrophotographic image forming apparatus employing the developing unit.

According to an aspect of the present invention, a developing unit includes a toner storage portion for containing toner, a development portion for containing the toner supplied from the toner storage portion and in which a developing roller for supplying the toner to a photosensitive body is installed, and a supply roller and an auxiliary supply roller installed at the development portion, the supply roller and the auxiliary supply roller rotating while facing each other to supply the toner to the developing roller, wherein an inequality that $|D-(R1+R2)|\leq 1.0$ mm is satisfied, where a distance between the centers of the auxiliary supply roller and the supply roller in a region where the auxiliary supply roller and the supply roller face each other is D, a radius of the supply roller is R1, and a radius of the auxiliary supply roller is R2.

The auxiliary supply roller may be located under the supply roller and at a more downstream side than the supply roller with respect to a rotation direction of the developing roller.

The center of the auxiliary supply roller may be located between a vertical straight line passing through the center of the supply roller and a vertical straight line passing through the center of the developing roller.

The supply roller and the auxiliary supply roller may rotate such that surfaces of the supply roller and the auxiliary supply roller move in the same direction in a region where the supply roller and the auxiliary supply roller face each other, and the supply roller and the developing roller may rotate such that surfaces of the supply roller and the developing roller move in the opposite directions in the region where the supply roller and the developing roller face each other.

A rotation linear velocity of the auxiliary supply roller may be about 50-90% of a rotation linear velocity of the supply roller.

The developing unit may include first and second gears which are respectively inserted around rotation shafts of the supply roller and the auxiliary supply roller, the first and second gears being directly engaged with each other. The number of teeth of the second gear may be greater than the number of teeth of the first gear.

The developing unit may further include a restriction member located at a downstream side of the auxiliary supply roller with respect to a rotation direction of the developing roller and restricting the amount of toner adhering to a surface of the developing roller.

The toner storage portion may be located at a side portion of the development portion.

The toner storage portion may be located under the development portion. The developing unit may further include a partition wall dividing the toner storage portion and the development portion, having an opening portion located under the lowest portion of the supply roller, and forming a path of the toner that is supplied from the toner storage portion to the development portion; and a toner supply member located in the toner storage portion and supplying the toner to the development portion through the opening portion.

According to another aspect of the present invention, an electrophotographic image forming apparatus includes a photosensitive body, an exposing unit for forming an electrostatic latent image on the photosensitive body, a developing unit for developing the electrostatic latent image by supplying toner to the electrostatic latent image, the developing unit including a toner storage portion for containing toner, a development portion for containing the toner supplied from the toner storage portion and in which a developing roller for supplying the toner to a photosensitive body is installed, and a supply roller and an auxiliary supply roller installed at the development portion, the supply roller and the auxiliary supply roller rotating while facing each other to supply the toner to the developing roller, wherein an inequality that $|D-(R1+R2)|\leq 1.0$ mm is satisfied, where a distance between the centers of the auxiliary supply roller and the supply roller in a region where the auxiliary supply roller and the supply roller face each other is D, a radius of the supply roller is R1, and a radius of the auxiliary supply roller is R2, and a fusing unit for fusing a toner image transferred to a recording medium.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

Figure 1:
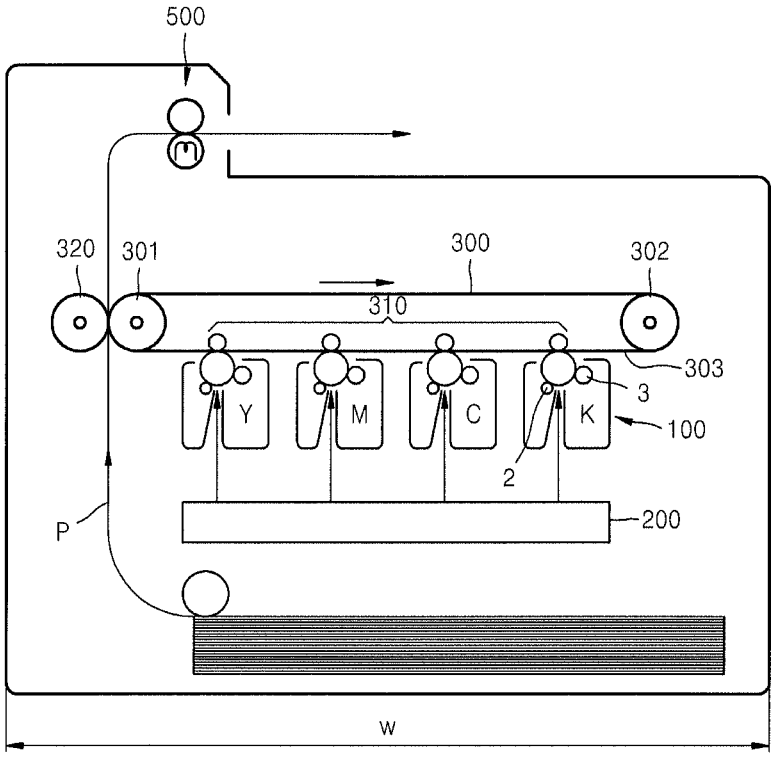
FIG. 1 illustrates a structure of an image forming apparatus according to an embodiment of the present invention.

The attached drawings for illustrating exemplary embodiments of the present invention are referred to in order to gain a sufficient understanding of the present invention, the merits thereof, and the objectives accomplished by the implementation of the present invention. Hereinafter, the present invention will be described in detail by explaining exemplary embodiments of the invention with reference to the attached drawings. Like reference numerals in the drawings denote like elements.

Figure 2:
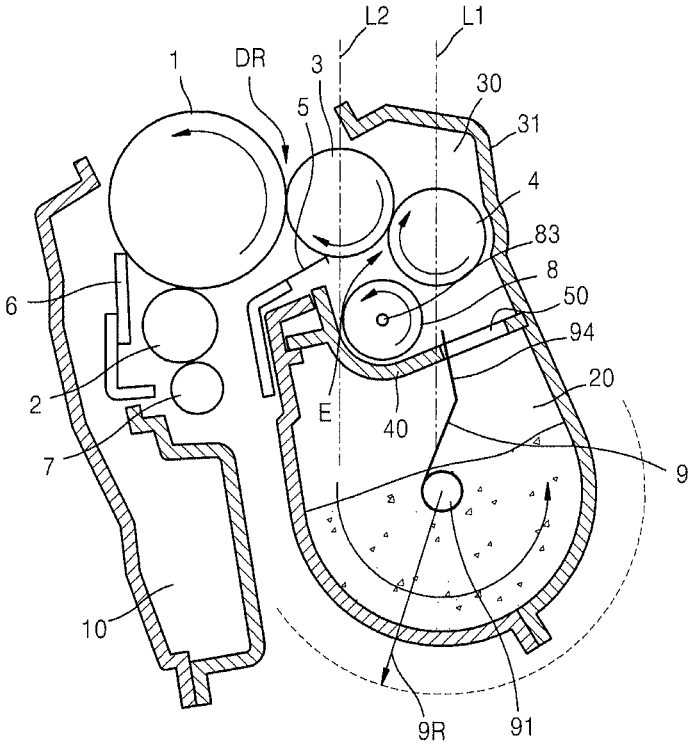
FIG. 2 illustrates a structure of a developing unit according to an embodiment of the present invention.

FIG. 1 illustrates a structure of an image forming apparatus according to an embodiment of the present invention. FIG. 2 illustrates a structure of a developing unit employed in the image forming apparatus of FIG. 1. The image forming apparatus according to the present embodiment is a color image forming apparatus for forming a color image by using four developing units 100 respectively containing toners of cyan C, magenta M, yellow Y, and black K colors. The color image forming apparatus of FIG. 1 is referred to as a tandem-type color image forming apparatus. In the following descriptions, members used to form an image of cyan C, magenta M, yellow Y, and black K colors are respectively indicated with suffixes of C, M, Y, and K at the end of each reference numeral.

Referring to FIG. 1, the image forming apparatus according to the present embodiment includes an intermediate transfer belt 300, an exposing unit 200, the four developing units 100, four intermediate transfer rollers 310, a final transfer roller 320, and a fusing unit 500.

The intermediate transfer belt 300 is an intermediate transfer medium to which a toner image is temporarily transferred before its final transfer to a recording medium P, and runs endlessly by being supported by support rollers 301 and 302. Each of the four developing units 100 includes a charge roller 2, a photosensitive drum 1, and a developing roller 3. The photosensitive drum 1 is an example of the photosensitive body on which an electrostatic latent image is formed. The photosensitive drum 1 includes a photosensitive layer having photoconductivity formed on an outer circumference of a circular metal pipe. The charge roller 2 is an example of a charger for charging a surface of the photosensitive drum 1 to a uniform electric potential. A corona charging unit may be employed instead of the charge roller 2. The exposing unit 200 scans light modulated according to image information onto the photosensitive drum 1 to form an electrostatic latent image. A light emitting diode (LED) type exposing unit for selectively emitting LED light according to the image information via a plurality of LEDs arranged in a main scanning direction may be used as the exposing unit 200. Also, a laser scanning unit (LSU) for scanning light emitted by a laser diode onto the photosensitive drum 1 by deflecting the light in the main scanning direction by using a light deflector may be used as the exposing unit 200. The developing roller 3 allows the toner contained in each of the four developing units 100 to adhere to the electrostatic latent image formed on the photosensitive drum 1, thereby forming a toner image.

The four developing units 100 are arranged such that the photosensitive drum 1 faces a lower surface 303 of the intermediate transfer belt 300. The photosensitive drum 1 may contact the lower surface 303 of the intermediate transfer belt 300. The four intermediate transfer rollers 310 are an example of an intermediate transfer unit for transferring the toner image formed on the photosensitive drum 1 to the intermediate transfer belt 300. The four intermediate transfer rollers 310 are respectively located facing the four photosensitive drums 1, with the lower surface 303 of the intermediate transfer belt 300 interposed therebetween. An intermediate transfer bias voltage to transfer the toner image formed on the photosensitive drum 1 to the intermediate transfer belt 300 may be applied to the four intermediate transfer rollers 310. A corona transfer unit may be employed instead of each of the four intermediate transfer rollers 310.

The final transfer roller 320 is an example of a final transfer unit for transferring the toner image on the intermediate transfer belt 300 to the recording medium P. A final transfer bias voltage to transfer the toner image on the intermediate transfer belt 300 to the recording medium P may be applied to the final transfer roller 320. A corona transfer unit may be employed instead of the final transfer roller 320. The fusing unit 500 fuses the toner image transferred to the recording medium P by applying heat and pressure to the toner image.

A color image forming process according to the above-described structure will be briefly described below.

First, according to image information of a black K color, the exposing unit 200 scans light onto the photosensitive drum 1K charged to a uniform electric potential by the charge roller 2K, thereby forming an electrostatic latent image. When a development bias is applied to the developing roller 3K of the developing unit 100K, black toner contained in the developing unit 100K adheres to the electrostatic latent image. A black toner image developed on the photosensitive drum 1K is transferred to the intermediate transfer belt 300 by an intermediate bias voltage applied to the intermediate transfer roller 310K. Toner images of cyan C, magenta M, and yellow Y colors are transferred to the intermediate transfer belt 300 through the same process and thus a color toner image is formed on the intermediate transfer belt 300. The color toner image is transferred to the recording medium P by a final transfer bias voltage applied to the final transfer roller 320. The color toner image is fused on the recording medium P by the fusing unit 500.

Heat generated by the fusing unit 500 may affect the photosensitive drum 1, the toner contained in the four developing units 100, and the exposing unit 200. Since the intermediate transfer belt 300 is interposed between the fusing unit 500, the four developing units 100, and the exposing unit 200 in the image forming apparatus configured as above, the four developing units 100, the photosensitive drum 1, and the exposing unit 200 may be less affected by the heat of the fusing unit 500.

In order to increase the toner capacity of the four developing units 100, an internal volume of each of the four developing units 100 is increased. When the volume of each of the four developing units 100 is increased in a widthwise direction, the width W of the image forming apparatus is increased so that the footprint of the image forming apparatus is increased. Thus, to increase the toner capacity of the four developing units 100 without increasing the footprint of the image forming apparatus, the four developing units 100 may be increased in a vertical direction, that is, downwardly. In this case, the toner in each of the four developing units 100 may be conveyed in the opposite direction to gravity to be supplied to the developing roller 3.

FIG. 2 illustrates a detailed structure of one of the four developing units 100 of FIG. 1. Referring to FIG. 2, a cleaning roller 7 is an example of a charge roller cleaning member for removing foreign materials adhered to an outer circumference of the charge roller 2. A cleaning member 6 removes residual toner and foreign materials from a surface of the photosensitive drum 1 before charging. The cleaning member 6 may be, for example, a cleaning blade having a leading end contacting the surface of the photosensitive drum 1. The residual toner and foreign materials removed from the photosensitive drum 1 may be stored in a waste toner containing unit 10.

The developing roller 3 is located facing the photosensitive drum 1. When a contact type development method is employed, the developing roller 3 may rotate in contact with the photosensitive drum 1. When a non-contact type development method is employed, the developing roller 3 is separated from the photosensitive drum 1. The interval between the developing roller 3 and the photosensitive drum 1 may be set to be about several tens to several hundreds of microns. A supply roller 4 supplies toner toward an outer circumferential surface of the developing roller 3.

A restriction member 5 restricts the amount of toner supplied to a development region DR between the photosensitive drum 1 and the developing roller 3 facing each other. For example, the restriction member 5 may be a restriction blade that elastically contacts the outer circumferential surface of the developing roller 3.

The developing unit 100 of the present embodiment includes a development portion 30 and a toner storage portion 20. The development portion 30 is located above the toner storage portion 20. The toner is contained in the toner storage portion 20. A toner supply member 9 for supplying the contained toner to the development portion 30 is installed. The development portion 30 and the toner storage portion 20 are divided in a vertical direction by a partition wall 40.

The developing roller 3 and the supply roller 4 are installed in the development portion 30. The supply roller 4 rotates in contact with the developing roller 3 or is separate from the developing roller 3 with a predetermined interval. The supply roller 4 supplies the toner contained in the development portion 30 to the developing roller 3.

An opening portion 50 for forming a path through which the toner may be supplied from the toner storage portion 20 to the development portion 30 is provided in the partition wall 40. In order for the opening portion 50 to be located above the lowest portion of the supply roller 4, a right outer wall 31 of the development portion 30 needs to extend to the right in FIG. 2. Then, the width of the developing unit 100 increases so that the overall footprint of the image forming apparatus may be increased. However, to minimize an increase in the footprint of the image forming apparatus, the opening portion 50 is located under the lowest portion of the supply roller 4. Also, at least a part of the opening portion 50 is overlapped with a vertical projection area of the supply roller 4.

Figure 3:
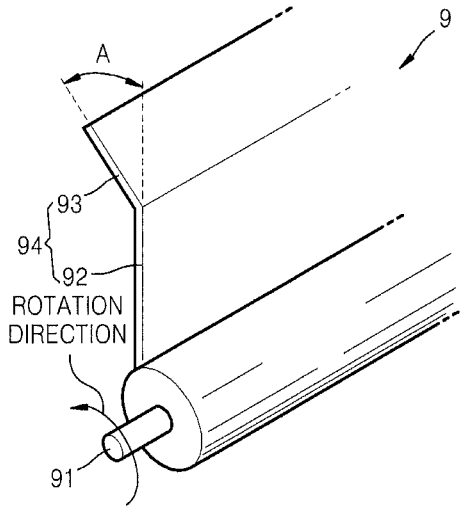
FIG. 3 is a perspective view of a toner supply member according to an embodiment of the present invention.
Figure 4:
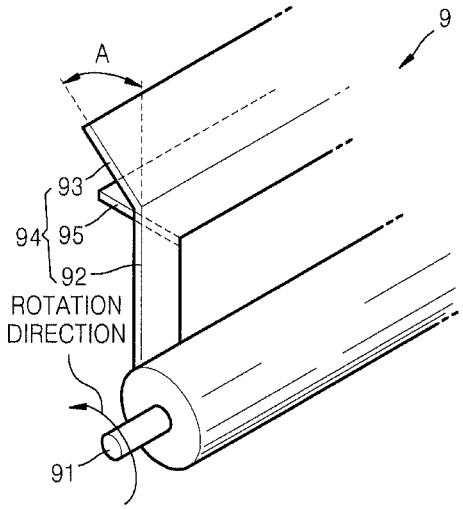
FIG. 4 is a perspective view of a toner supply member according to another embodiment of the present invention.

The toner supply member 9 may include a rotation shaft 91 and a wing portion 94 formed on the rotation shaft 91 and having elasticity. When the toner supply member 9 rotates, the wing portion 94 elastically contacts a wall portion forming the toner storage portion 20 and conveys toner to the development portion 30 through the opening portion 50. To increase a rate of use of the toner in the toner storage portion 20, the wing portion 94 is formed with a rotation radius 9R that is larger than the longest distance from the rotation shaft 91 to an inner wall of the toner storage portion 20 and the partition wall 40. Accordingly, since an end portion of the wing portion 94 enters in the development portion 30 through the opening portion 50, the toner may be effectively conveyed to the development portion 30. Referring to FIG. 3, the wing portion 94 may include a body 92 and a first bent portion 93 bent at an acute angle "A" from the body 92 in a rotation direction of the wing portion 94. Since the body 92 and the first bent portion 93 form a concave space, the toner may be more effectively conveyed to the development portion 30. Also, referring to FIG. 4, a second bent portion 95 extending from the body 92 in the rotation direction may be further included in the wing portion 94. The second bent portion 95 may extend from the first bent portion 93. Since the second bent portion 95 with the first bent portion 93 forms a concave space to convey the toner, the toner may be conveyed more effectively to the development portion 30. According to the above-described structure, as the toner supply member 9 rotates, the wing portion 94 may convey the toner by elastically contacting the wall forming the toner storage portion 20 and supply the toner to the development portion 30 through the opening portion 50.

In the above-described structure, the toner supplied to the development portion 30 may be supplied by the supply roller 4 to the developing roller 3 and may adhere to the surface of the developing roller 3. The supply roller 4 may rotate in the same direction as the rotation direction of the developing roller 3. That is, the surface of the supply roller 4 and the surface of the developing roller 3 are moved in the opposite directions in a region E where the supply roller 4 and the developing roller 3 face each other. Accordingly, the toner remaining on the surface of the developing roller 3 after passing through the development region DR is removed by the supply roller 4 at the upstream side of the region E with respect to the rotation direction of the developing roller 3, and new toner may adhere to the surface of the developing roller 3 in the region E.

Referring to FIG. 2, an auxiliary supply member 8 may be installed in the development portion 30. The auxiliary supply member 8 is located between the partition wall 40 and the supply roller 4 to supply toner to the region E. The auxiliary supply member 8 is located at a more downstream side than the supply roller 4 with respect to the rotation direction of the developing roller 3. A rotation center 83 of the auxiliary supply member 8 is located between a vertical straight line L2 passing through the center of the developing roller 3 and a vertical straight line L1 passing through the center of the supply roller 4. The opening portion 50 is not overlapped with a vertical projection of the auxiliary supply member 8. Otherwise, toner would fall from the development portion 30 to the toner storage portion 20 through the opening portion 50 and toner supply performance of the auxiliary supply member 8 would deteriorate.

Toner is supplied from the toner storage portion 20 to the development portion 30 according to a rotation cycle of the toner supply member 9. When the wing portion 94 of the toner supply member 9 pushes the toner into the development portion 30 through the opening portion 50, a toner pressure is applied to the region E. When the wing portion 94 is out of the opening portion 50, the toner pressure in the region E may decrease so that a sufficient amount of toner may not adhere to the developing roller 3. As the auxiliary supply member 8 also applies a toner pressure to the region E, a sufficient amount of toner may be supplied to the developing roller 3.

Figure 5:
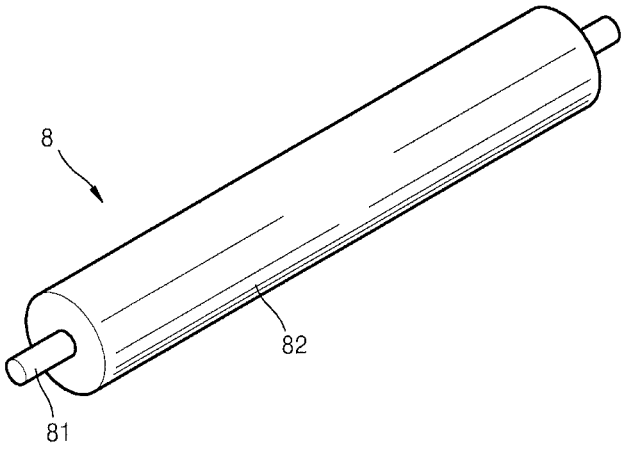
FIG. 5 is a perspective view of an auxiliary supply roller according to an embodiment of the present invention.

The auxiliary supply member 8 may have, for example, a roller shape formed of a metal material or a plastic material, as illustrated in FIG. 5. When the auxiliary supply member 8 includes a rotation shaft 81 and a roller portion 82, the roller portion 82 may be formed of a plastic, metal, or rubber material. The roller portion 82 may have a porous structure such as sponge. Also, a surface of the roller portion 82 may have a surface roughness.

The auxiliary supply member 8 rotates in the opposite direction to the rotation direction of the supply roller 4. That is, in a region where the auxiliary supply member 8 faces the supply roller 4, the direction in which the surface of the auxiliary supply member 8 moves is the same as the direction in which the surface of the supply roller 4 moves. According to the above-described structure, the rotational forces of the supply roller 4 and the auxiliary supply roller 8 may effectively work as a toner conveying force in passing through the region where the auxiliary supply member 8 and the supply roller 4 face each other.

Figure 6:
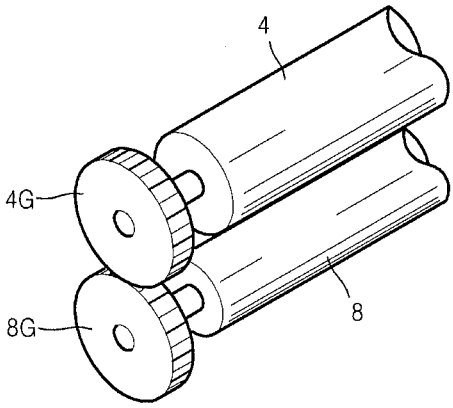
FIG. 6 is a perspective view illustrating a part of a gear engagement structure for rotating the supply roller and the auxiliary supply roller.

In order for the auxiliary supply member 8 to rotate in the opposite direction to the rotation direction of the supply roller 4, as illustrated in FIG. 6, first and second gears 4G and 8G are respectively coupled to the rotation shafts of the supply roller 4 and the auxiliary supply member 8 so that the first and second gears 4G and 8G are directly engaged with each other. When the auxiliary supply member 8 rotates in the same direction as the supply roller 4, the rotation force fails to work effectively as a toner conveying force in the region, and an odd number of idle gears are required to be installed between the first and second gears 4G and 8G.

Figure 7:
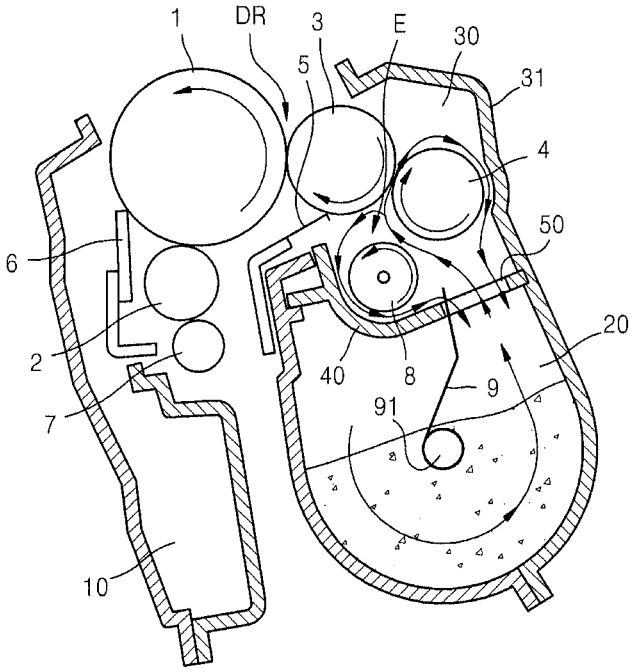
FIG. 7 illustrates a toner circulation process in the developing unit of FIG. 2, according to an embodiment of the present invention.

Referring to FIG. 7, the toner supplied by the toner supply member 9 from the toner storage portion 20 to the development portion 30 is conveyed to the region E and applies a toner pressure to the region E. Excess toner is removed from the region E through a gap between the auxiliary supply member 8 and the partition wall 40. Also, the toner removed from the developing roller 3 by the supply roller 4 at the upstream of the region E is discharged through a gap between the supply roller 4 and the right outer wall 31. The removed toner falls down to the toner storage portion 20 through the opening portion 50. Thus, an appropriate toner pressure is maintained in the region E. The toner removed from the region E is mixed with the toner in the toner storage portion 20 and supplied back to the development portion 30. As the toner circulates as described above, the toner may be effectively supplied to the developing roller 3 in the opposite direction to gravity. Thus, the developing unit 100 may be enlarged in the gravity direction and the toner capacity of the developing unit 100 may be increased without increasing the dimension of the developing unit 100 in a widthwise direction. In other words, the footprint of the image forming apparatus may be reduced. Also, since the toner may be uniformly and stably supplied to the developing roller 3, uniformity in the quality of an image may be obtained.

The auxiliary supply member 8 and the supply roller 4 may rotate in contact with each other or may be separated from each other. The toner conveyed from the toner storage portion 20 to the development portion 30 is supplied to the region E by passing through the region where the auxiliary supply member 8 and the supply roller 4 face each other by the rotational forces of the auxiliary supply member 8 and the supply roller 4. That is, the rotational forces of the auxiliary supply member 8 and the supply roller 4 provide kinetic energy to the toner that is powder so that the toner is supplied to the region E by the kinetic energy. In order to stably and uniformly convey the toner to the region E while the auxiliary supply member 8 and the supply roller 4 rotate facing each other, the distance between the auxiliary supply member 8 and the supply roller 4 needs to be regulated. When the distance between the auxiliary supply member 8 and the supply roller 4 is too large, the rotational forces of the auxiliary supply member 8 and the supply roller 4 do not effectively work as a toner conveying force so that the fluidity and supply of the toner may be deteriorated. Also, when the amount of contact between the auxiliary supply member 8 and the supply roller 4 is too large, rotation load may be excessively increased.

Figure 8:
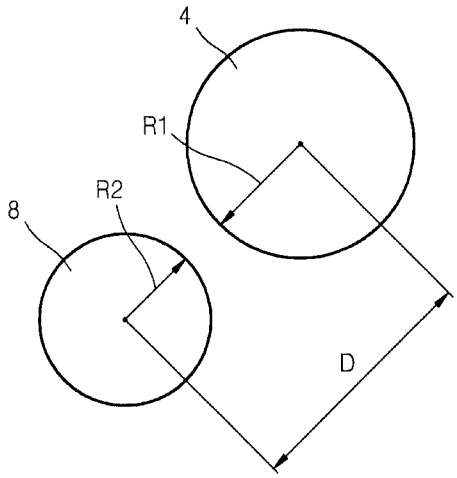
FIG. 8 illustrates a distance between the auxiliary supply roller and the supply roller.

Referring to FIG. 8, assuming that the distance between the centers of the auxiliary supply member 8 and the supply roller 4 in the region where the auxiliary supply member 8 and the supply roller 4 face each other is D, the radius of the supply roller 4 is R1, and the radius of the auxiliary supply member 8 is R2, when the following inequality 1 is satisfied, a superior toner supply characteristic may be obtained.

$$|D-(R1+R2)|\leq 1.0\text{ mm} \qquad \text{<Inequality 1>}$$

That is, when the distance between the surfaces of the auxiliary supply member 8 and the supply roller 4 in the region where the auxiliary supply member 8 and the supply roller 4 face each other is between −1 mm and +1 mm, superior toner supply characteristic may be obtained. When the distance between the surfaces of the auxiliary supply member 8 and the supply roller 4 is a positive (+) value, it means that the surfaces of the auxiliary supply member 8 and the supply roller 4 are separated from each other. When the distance between the surfaces of the auxiliary supply member 8 and the supply roller 4 is a negative (−) value, it means that the surfaces of the auxiliary supply member 8 and the supply roller 4 are in contact with each other or by being overlapped with each other. When the distance between the surfaces of the auxiliary supply member 8 and the supply roller 4 is greater than 1.0 mm, the rotational forces of the auxiliary supply member 8 and the supply roller 4 do not effectively work as a toner conveying force. Then, the amount of the toner supplied to the developing roller 3 becomes insufficient so that the concentration of a printed image is deteriorated or becomes irregular. Also, when the amount of overlapping between the surfaces of the auxiliary supply member 8 and the supply roller 4 is greater than 1.0 mm, rotation load of the auxiliary supply member 8 and the supply roller 4 may become severe so that a toner conveying characteristic may be deteriorated. When the auxiliary supply member 8 and the supply roller 4 rotate in contact with each other or overlap each other, at least one of the auxiliary supply member 8 and the supply roller 4 may have a surface formed of an elastic material such as rubber, foamed rubber, or sponge.

Table 1 shows a result of the relative quality of a printed image by varying the distance between the surfaces of the auxiliary supply member 8 and the supply roller 4. The results show that, when the Inequality 1 is satisfied, a sufficient amount of toner is uniformly supplied to the developing roller 3 so that an image of a uniform and superior quality may be obtained.

TABLE 1

| | Experiment 1 | Experiment 2 | Experiment 3 | Experiment 4 |
|---|---|---|---|---|
| Distance between surfaces of the auxiliary supply member and the supply roller (mm) | 1.1 | 0.8 | 0.6 | 0.25 |
| Image quality | Defective | Not bad | Excellent | Excellent |

The toner supply characteristic may be affected by the rotation speeds of the auxiliary supply member 8 and the supply roller 4. When the ratio of the rotation speed between the auxiliary supply member 8 and the supply roller 4 is about 50-90%, a superior toner supply characteristic may be obtained.

Figure 9:
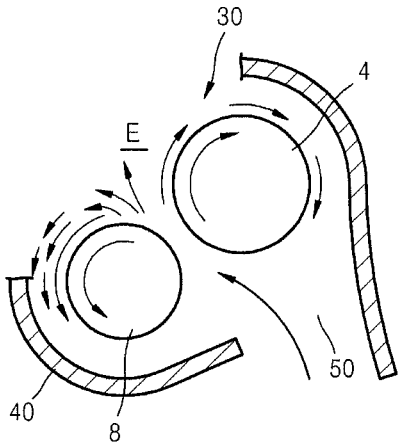
FIG. 9 illustrates an operation of toner when the distance between the auxiliary supply roller and the supply roller is excessively large.

When the rotation linear velocity of the auxiliary supply roller 8 is too fast, as illustrated in FIG. 9, the toner supplied to the development portion 30 through the opening portion 50 may strongly tend to escape from the region E through a gap between the partition wall 40 and the auxiliary supply roller 8 after passing through the region E other so that a toner supply characteristic toward the region E may be deteriorated. When the rotation linear velocity of the auxiliary supply roller 8 is too slow, a force to convey the toner supplied to the development portion 30 through the opening portion 50 toward the region E after passing through the region E is weakened so that a toner supply characteristic toward the region E may be deteriorated.

Table 2 shows a result of the relative quality of an image by varying a rate of the rotation linear velocity of the auxiliary supply roller 8 with respect to the rotation linear velocity of the supply roller 4. The results show that, when the rotation linear velocity rate of the auxiliary supply roller 8 and the supply roller 4 is about 50-90%, a sufficient amount of toner is supplied to the developing roller 3 so that a uniform and superior quality of an image may be obtained.

TABLE 2

| | Experiment 1 | Experiment 2 | Experiment 3 | Experiment 4 | Experiment 5 |
|---|---|---|---|---|---|
| Rotation linear velocity Rate between the auxiliary supply member and the supply roller | 140% | 100% | 85% | 50% | 0% |
| Image quality | Defective | Not bad | Excellent | Excellent | Defective |

The rotation linear velocity rate of the auxiliary supply roller 8 and the supply roller 4 may be adjusted by varying the number of teeth of the first and second gears 4G and 8G. That is, the number of teeth of the second gear 8G may be greater than that of the first gear 4G considering the rotation linear velocity rate of the auxiliary supply roller 8 and the supply roller 4. In this case, a module of the first and second gears 4G and 8G may be adjusted considering the distance between the centers of the auxiliary supply roller 8 and the supply roller 4.

Figure 10:
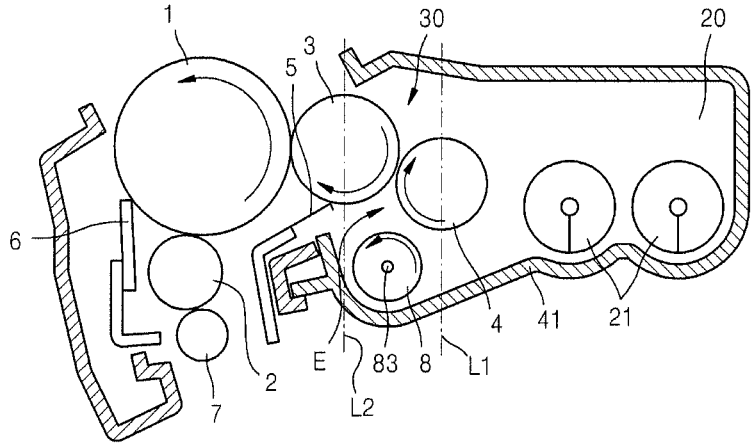
FIG. 10 illustrates a structure of a developing unit according to another embodiment of the present invention.

Although in the above-described embodiment the toner storage portion 20 is arranged under the development portion 30, the present invention is not limited thereto. For example, as illustrated in FIG. 10, the toner storage portion 20 may be arranged at the side of the development portion 30. One or more toner supply members 21 for supplying toner to the development portion 30 may be provided in the toner storage portion 20. The toner supply members 21 may be augers having spiral wings or elastic wing portion coupled to a rotational shaft.

The auxiliary supply roller 8 is located between the supply roller 4 and a lower wall 40 of the developing unit 100 and supplies toner to the region E where the supply roller 4 and the developing roller 3 face each other. The auxiliary supply roller 8 is located at a more downstream side than the supply roller 4 with respect to the rotation direction of the developing roller 3. A rotation center 83 of the auxiliary supply member 8 is located between a vertical straight line L2 passing through the center of the developing roller 3 and a vertical straight line L1 passing through the center of the supply roller 4.

Since the auxiliary supply roller 8 applies a toner pressure to the region E, a sufficient amount of toner may be supplied to the developing roller 3 without relying on the rotation cycle of the toner supply member 21. Since the movement direction of the surface of the auxiliary supply roller 8 is the same as that of the surface of the supply roller 4 in the region E, the rotational forces of the auxiliary supply member 8 and the supply roller 4 may effectively work to convey the toner passing through the region E.

The toner supplied by the toner supply members 21 from the toner storage portion 20 to the development portion 30 is conveyed to the region E through a gap between the auxiliary supply roller 8 and the supply roller 4 and applies a toner pressure to the region E. Excess toner is removed from the region E through the gap between the auxiliary supply member 8 and the lower wall 40. Also, the toner removed from the developing roller 3 by the supply roller 4 at the upstream of the region E is discharged to the toner storage portion 20 as the supply roller 4 rotates. Thus, an appropriate toner pressure is maintained in the region E. The toner removed from the region E is mixed with the toner in the toner storage portion 20 and supplied back to the development portion 30.

The auxiliary supply member 8 and the supply roller 4 may rotate in contact with each other or be separated from each other. Assuming that the distance between the centers of the auxiliary supply member 8 and the supply roller 4 in the region E is D, the radius of the supply roller 4 is R1, and the radius of the auxiliary supply member 8 is R2, when the above Inequality 1 is satisfied, a superior toner supply characteristic may be obtained. Also, when the rotation linear velocity rate of the auxiliary supply roller 8 and the supply roller 4 is about 50-90%, a superior toner supply characteristic may be obtained.

According to the above-described developing unit according to the present invention and the image forming apparatus adopting the same, toner may be uniformly and effectively conveyed to the developing roller regardless of the position of the toner storage portion to the development portion. Also, since the toner may be circulated between the toner storage portion and the development portion, the stagnation of toner in the toner storage portion and the development portion may be prevented. Therefore, a uniform image quality may be obtained.

While this invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A developing unit comprising, in order, from an upstream toner movement side to a downstream toner movement side of the unit:

a toner storage portion for containing toner;

a development portion for receiving the toner from the toner storage portion and including an auxiliary supply roller, a toner-supply roller, and a developing roller to supply the toner to a photosensitive body, the supply roller and the auxiliary supply roller rotating while facing each other to supply the toner downstream to the developing roller, wherein an inequality that $|D-(R1+R2)| \leq 1.0$ mm is satisfied, where a distance between centers of the auxiliary supply roller and the supply roller in a first region where the auxiliary supply roller and the supply roller face each other is D, a radius of the supply roller is R1, and a radius of the auxiliary supply roller is R2, wherein the supply roller faces the developing roller at a second region, wherein the auxiliary supply roller is located at a downstream side of the supply roller with respect to a rotation direction of the developing roller, wherein the auxiliary supply roller and the supply roller deliver the toner from the toner storage portion through the first region to the second region so that a toner pressure is supplied to the second region, wherein the auxiliary supply roller is separated from the developing roller by a space, and wherein some of the toner moves from the second region, through the space and back to the toner storage part, wherein the supply roller and the auxiliary supply roller rotate such that surfaces of the supply roller and the auxiliary supply roller move in the same direction in the first region, and the supply roller and the developing roller rotate such that surfaces of the supply roller and the developing roller move in opposite directions in the second region, and wherein the center of the auxiliary supply roller is located between a vertical straight line passing through the center of the supply roller and a vertical straight line passing through a center of the developing roller.

2. The developing unit of claim 1, wherein a rotation linear velocity of the auxiliary supply roller is 50-90% of a rotation linear velocity of the supply roller.

3. The developing unit of claim 2, further comprising first and second gears which are respectively located on rotation shafts of the supply roller and the auxiliary supply roller, the first and second gears being directly engaged with each other.

4. The developing unit of claim 3, wherein a number of teeth of the second gear is greater than a number of teeth of the first gear.

5. The developing unit of claim 1, further comprising a restriction member located downstream from the auxiliary supply roller for restricting an amount of toner adhering to a surface of the developing roller.

6. The developing unit of claim 1, wherein the toner storage portion is located at a side of the development portion.

7. The developing unit of claim 1, wherein the toner storage portion is located under the development portion.

8. The developing unit of claim 7, further comprising:

a partition wall dividing the toner storage portion and the development portion, having an opening portion located upstream of the supply roller, and defining a path for the toner supplied from the toner storage portion to the development portion; and a toner supply member located in the toner storage portion and supplying the toner to the development portion through the opening portion.

9. The developing unit of claim 8 wherein the opening portion does not overlap a vertical projection of the auxiliary supply roller.

10. The developing unit of claim 1, further comprising a toner supply member movable within the toner storage portion for moving toner from the toner storage portion to the development portion, wherein the toner supply member includes a flat blade fixed to a rotating shaft, and an angled blade attached to a free end of the member.

11. An electrophotographic image forming apparatus comprising:

a photosensitive body;

an exposing unit for forming an electrostatic latent image on the photosensitive body;

a developing unit for developing the electrostatic latent image by supplying toner to the electrostatic latent image, the developing unit including, in order, from an upstream toner movement side to a downstream toner movement side of the apparatus, a toner storage portion for containing toner;

a development portion for receiving the toner from the toner storage portion and including an auxiliary toner-supply roller, a toner supply roller, and a developing roller for supplying the toner to the photosensitive body, the supply roller and the auxiliary supply roller rotating while facing each other to supply the toner to the developing roller, wherein an inequality that $|D-(R1+R2)| \leq 1.0$ mm is satisfied, where a distance between centers of the auxiliary supply roller and the supply roller in a first region where the auxiliary supply roller and the supply roller face each other is D, a radius of the supply roller is R1, and a radius of the auxiliary supply roller is R2; and a fusing unit for fusing a toner image transferred to a recording medium, wherein the supply roller faces the developing roller at a second region, wherein the auxiliary supply roller is located at a downstream side of the supply roller with respect to a rotation direction of the developing roller, wherein the auxiliary supply roller and the supply roller deliver the toner from the toner storage portion through the first region to the second region so that a toner pressure is supplied to the second region, wherein the auxiliary supply roller is separated from the developing roller by a space, and wherein some of the toner moves from the second region, through the space and back to the toner storage part, wherein the supply roller and the auxiliary supply roller rotate such that surfaces of the supply roller and the auxiliary supply roller move in the same direction in the first region, and the supply roller and the developing roller rotate such that surfaces of the supply roller and the developing roller move in opposite directions in the second region, and wherein the center of the auxiliary supply roller is located between a vertical straight line passing through the center of the supply roller and a vertical straight line passing through a center of the developing roller.

12. The electrophotographic image forming apparatus of claim 11, wherein a rotation linear velocity of the auxiliary supply roller is 50-90% of a rotation linear velocity of the supply roller.

13. The electrophotographic image forming apparatus of claim 12, further comprising first and second gears which are respectively located on rotation shafts of the supply roller and the auxiliary supply roller, the first and second gears being directly engaged with each other.

14. The electrophotographic image forming apparatus of claim 11, further comprising a restriction member located downstream from the auxiliary supply roller to restrict an amount of toner adhering to a surface of the developing roller.

15. The electrophotographic image forming apparatus of claim 11, wherein the toner storage portion is located at a side of a development portion.

16. The electrophotographic image forming apparatus of claim 11, wherein the toner storage portion is located under a development portion.

17. The electrophotographic image forming apparatus of claim 16, wherein the developing unit further comprises:

a partition wall dividing the toner storage portion and the development portion, having an opening portion located upstream of the supply roller, and defining a path for the toner supplied from the toner storage portion to the development portion; and a toner supply member located in the toner storage portion and supplying the toner to the development portion through the opening portion.

18. The apparatus of claim 17, wherein the opening portion does not overlap a vertical projection of the auxiliary supply roller.

19. A developing unit comprising, in order from an upstream toner movement side to a downstream toner movement side of the unit:

a toner storage portion for containing toner;

a development portion for receiving the toner from the toner storage portion and including an auxiliary toner supply roller, a toner supply roller, and a developing roller to supply the toner to a photosensitive drum, the supply roller and the auxiliary supply roller rotating while facing each other to supply the toner to the developing roller, wherein an inequality that $|D-(R1+R2)| \leq 1.0$ mm is satisfied, where a distance between centers of the auxiliary supply roller and the supply roller in a region where the auxiliary supply roller and the supply roller face each other is D, a radius of the supply roller is R1, and a radius of the auxiliary supply roller is R2, and wherein a rotation linear velocity of the auxiliary supply roller is 50%-90% of a rotation linear velocity of the supply roller, first and second gears which are located respectively on rotation shafts of the supply roller and the auxiliary supply roller, the first and second gears being directly engaged with each other, wherein a number of teeth of the second gear is greater than a number of teeth of the first gear;

a partition wall dividing the toner storage portion and the development portion, having an opening portion located upstream of the supply roller, and defining a path for the toner supplied from the toner storage portion to the development portion; and a toner supply member located in the toner storage portion and supplying the toner to the development portion through the opening portion.

20. The developing unit of claim 19, wherein the center of the auxiliary supply roller is located between a vertical straight line passing through the center of the supply roller and a vertical straight line passing through a center of the developing roller.

21. The developing unit of claim 19, wherein the supply roller and the auxiliary supply roller rotate such that surfaces of the supply roller and the auxiliary supply roller move in the same direction in the region, and the supply roller and the developing roller rotate such that surfaces of the supply roller and the developing roller move in opposite directions in a region where the supply roller and the developing roller face each other.

22. The developing unit of claim 19, further comprising a restriction member located downstream from the auxiliary supply roller to restrict an amount of toner adhering to a surface of the developing roller.

23. The developing unit of claim 19, wherein the toner storage portion is located at a side of the development portion.

24. The developing unit of claim 19, wherein the toner storage portion is located under the development portion.

* * * * *

UNITED STATES PATENT AND TRADEMARK OFFICE

CERTIFICATE OF CORRECTION

PATENT NO. : 9,020,404 B2
APPLICATION NO. : 13/075770
DATED : April 28, 2015
INVENTOR(S) : Jin-hong Kim et al.

It is certified that error appears in the above-identified patent and that said Letters Patent is hereby corrected as shown below:

Claims

Claim 1, Column 10, Line 60

Delete “toner-supply” and insert --supply--, therefor.

Claim 1, Column 11, Line 15

Delete “space, and” and insert --space--, therefor.

Claim 11, Column 12, Line 11-12

Delete “toner-supply” and insert --supply--, therefor.

Claim 11, Column 12, Line 12

Delete “toner supply” and insert --supply--, therefor.

Signed and Sealed this
Twentieth Day of October, 2015

Michelle K. Lee

Michelle K. Lee
*Director of the United States Patent and Trademark Office*